US005607102A

United States Patent [19]

Walsh et al.

[11] Patent Number: 5,607,102

[45] Date of Patent: Mar. 4, 1997

[54] TAMPER-RESISTANT CASH BOX

[76] Inventors: Michael J. Walsh, 5724 Aluffo Rd., Paso Robles, Calif. 93446; Gerald R. Gerent, 1255 Grandview Rd., Vista, Calif. 92084

[21] Appl. No.: 570,354

[22] Filed: Dec. 11, 1995

[51] Int. Cl.[6] ..... B65D 91/00

[52] U.S. Cl. ..... 232/1 D; 232/15; 109/52; 109/66; 109/45

[58] Field of Search ..... 232/43.2, 1 D, 232/7, 12, 15, 16; 109/66, 67, 68, 52, 45, 46

[56] References Cited

U.S. PATENT DOCUMENTS

| | | | |
|---|---|---|---|
| 1,852,053 | 4/1932 | Jendrek | 109/66 |
| 3,292,849 | 12/1966 | Ewing . | |
| 3,433,185 | 3/1969 | Roberts . | |
| 4,080,908 | 3/1978 | Bianco . | |
| 4,278,033 | 7/1981 | Sobel . | |
| 4,452,390 | 6/1984 | West . | |
| 4,462,317 | 7/1984 | Franko et al. . | |
| 4,493,268 | 1/1985 | Sidler . | |
| 4,616,776 | 10/1986 | Blumenthal et al. | 109/52 X |
| 4,638,746 | 1/1987 | Ishigure . | |
| 4,648,327 | 3/1987 | Toth et al. | 109/66 X |
| 4,896,826 | 1/1990 | Bernier . | |
| 5,170,907 | 12/1992 | Sakai | 109/52 X |

*Primary Examiner*—Blair Johnson

[57] ABSTRACT

A tamper-resistant cash box combination including a cash box support structure defining a storage cavity accessible through a front opening, a closed cash box sized to fit snugly into the structure containing a front panel for fitting flush with the structure front opening, the front panel forming a first slot therethrough for passing currency and the like into the box, a bolt inside the cash box in slidable engagement with the front panel, the bolt defined by a top end and a bottom end, and a lock on the cash box front panel for moving the bolt upward to cover the first slot and downward through a second slot formed in the bottom of the cash box into a third slot formed in the bottom of the structure to lock the cash box in the structure where actuation of the lock in one direction locks the cash box in the structure and simultaneously opens the currency-passing first slot for access to the interior of the cash box and actuation of the lock in the other direction unlocks the cash box from the structure for removal therefrom and simultaneously closes the currency-passage first slot to prevent further access to the interior of the cash box.

30 Claims, 7 Drawing Sheets

TAMPER-RESISTANT CASH BOX

BACKGROUND OF THE INVENTION

1. Field of the Invention

This invention relates to currency security boxes which are commonly used to accept bills, coins, tokens and other types of currency and the like. More particularly, this invention pertains to a unique cash box combination that automatically locks and becomes tamper-resistant the moment it is unlocked for removal from its housing.

2. Description of the Prior Art

Cash boxes are used throughout the commercial world as receptacles for receiving and storing cash and the like in locked storage until the owner or appropriate official can remove it from operation for subsequent processing. Because the box holds currency it is often the subject of tampering. Normally, one person possesses the key to unlock the cash box for removal to be periodically emptied. Tampering often occurs when the box is unlocked for emptying and/or replaced with an empty box. Further, many boxes have a non-closable entry slot that is susceptible to having currency withdrawn by the use of thin wires or string passed through the entry slot and into the box.

Numerous patents have been issued disclosing and claiming various modifications to cash boxes in order to make them useful for accepting and retaining currency and adaptable to easy access by authorized personnel. U.S. Pat. Nos. 3,292,849; 3,433,185; 4,080,908; 4,278,033; 4,452,390; 4,462,317; 4,493,268; 4,638,746; and, 4,896,826 are just a few of these patents. All of them come at a high cost, however, because the devices attached to them require extra manufacturing material and extra labor resulting in a high retail cost. In addition, most of them require training of personnel so that higher wages are required for management personnel. Finally, numerous locks and keys are required to open and close the many drawers and doors to these items. All of these disadvantages makes this part of business highly expensive and heavily managed.

SUMMARY OF THE INVENTION

This invention is a unique cash box combination that is tamper-resistant yet requires little or no training to operate. It comprises a novel joinder of a cash box and a cash box housing where the intake slot in the cash box is linked to the lock that retains the box in its housing. While the box is locked in the housing, the slot is open to accept currency. When the box is unlocked for removal from the housing (to be replaced by a new or empty box) the same lock that unlocks the box from the housing locks the slot against further passage of currency therethrough in either direction. Means reside in the cash box to prevent entry by string or wire or other theft device to remove any currency already placed therein. Only one lock controls the entire operation. Thus, fewer keys are needed, there is less handling of the cash box and the threat of tampering is greatly reduced. The boxes are plain, require little in the way of special equipment, and are thus within the financial reach of most business persons.

The invention is a tamper-resistant cash box combination comprising a cash box housing having integrally connected top, bottom, side and rear housing plates defining a storage cavity therein accessible through a front opening, a closed cash box is provided, sized to slide into and fit snugly with said housing and includes a front panel adapted to fit flush against the front housing opening, a first slot is formed in the cash box front panel opening into the interior of the box for passing currency and the like thereinto, a heavy bolt is slidably positioned inside the cash box front panel and against the surface thereof and is defined by an upper end, of a length and width to close over the first slot to completely close all access to the interior to the cash box, and a lower end of a length and width to pass through a second slot formed in the floor of the cash box and thence fit into a third slot formed in the bottom housing plate to lock the cash box in the housing, and a rotatable lock is mounted in the cash box front panel engaging the bolt and accessible from the outside with an insertable key, so that rotation of the key in one direction drops the bolt through the second slot into the third slot in the bottom housing plate to lock the cash box in the housing and simultaneously open the currency passing first slot, while rotation of the key in the opposite direction lifts the bolt from the second and third slots to allow the cash box to be withdrawn from the housing and simultaneously lifts the bolt to close the currency passing first slot to secure the contents therein. Another unique aspect of this invention involves storage of the cash boxes in the housing. In some cases the cash box filled with cash or other valuables is required to be stored in a protective area until it is obtained by appropriate personnel. In this situation, means are provided to lock the cash box in the housing while maintaining the cash box in a closed locked condition. The unique aspect of this is that parts of the same security system may be shared by other security devices.

Accordingly, the main object of this invention is a tamper-resistant cash box that locks the box in its housing simultaneously with opening the currency passing slot into the box, and, alternatively, unlocks the box for removal from the housing while simultaneously closing and locking the currency passing slot to prevent tampering with the contents therein. Other objects of the invention include a cash box with a rear openable door that resides in hidden and locked arrangement inside the housing when the box is locked in the housing in use; a cash box that has a handle on the front panel for easy pulling thereof from the housing; a cash box that uses strips of low frictional material to aid in inserting and withdrawing the box from the housing; an invention where multiple cash boxes can be housed in side-by-side arrangement in one housing; a cash box whose housing contains means for mounting the housing underneath an overhead support member for easy access to the currency passing slot; a cash box having means interior thereof for preventing unauthorized entry thereinto for the purpose of stealing or tampering with the contents thereof; a cash box that may be locked in a housing in a closed and locked condition or an open and locked condition; a cash box combination of simple and rugged construction that is low cost, easily installed and convenient to use; a cash box combination that denies access to the interior of the cash box when not locked in operable position; a cash box that is accessible by authorized personnel through a door different from the one used to pass currency thereinto; a cash box combination that is easy to use, that requires no specialized training and that is useful by a work force having a lower degree of education such as is becoming prevalent in the work place.

These and other objects of the invention will become more apparent by reading the following Description of the Preferred Embodiment taken together with the drawings that are appended hereto. The scope of protection sought by the inventors may be gleaned from a fair reading of the claims that conclude this specification.

DESCRIPTION OF THE PREFERRED EMBODIMENT

Figure 1:
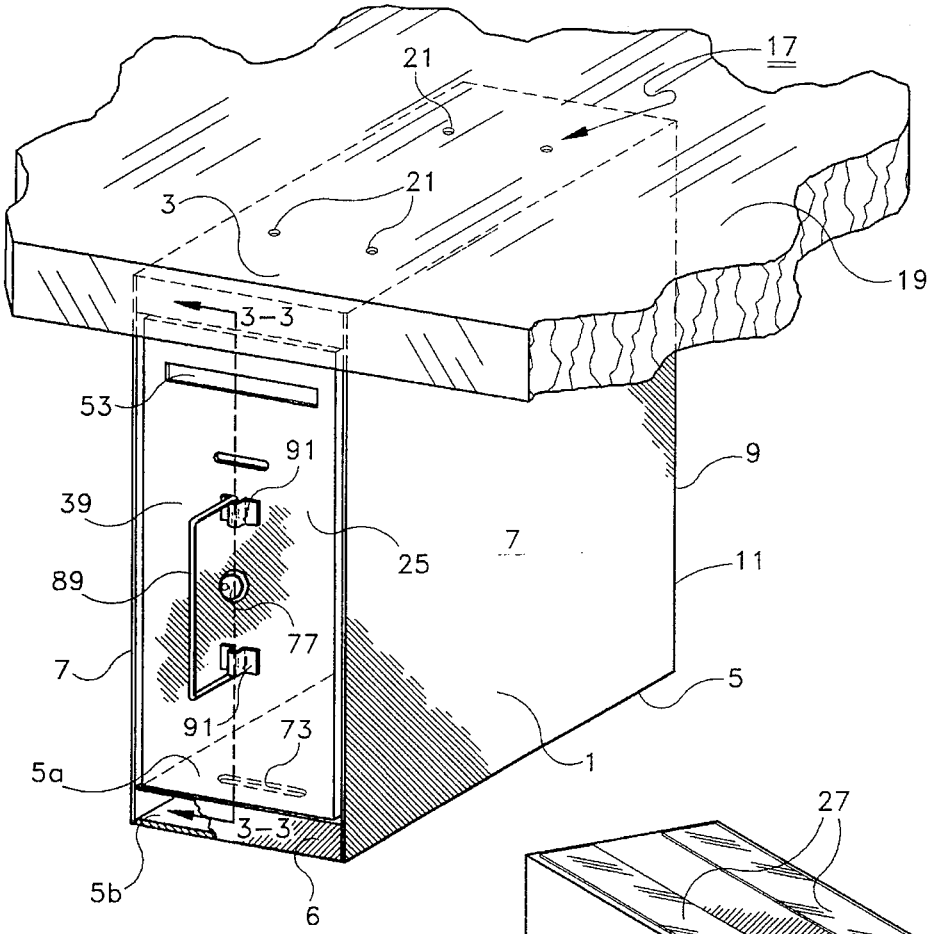
FIG. 1 is a trimetric view of the preferred embodiment of this invention shown mounted in its housing, where the housing is attached to the underside of a supporting member.
Figure 5:
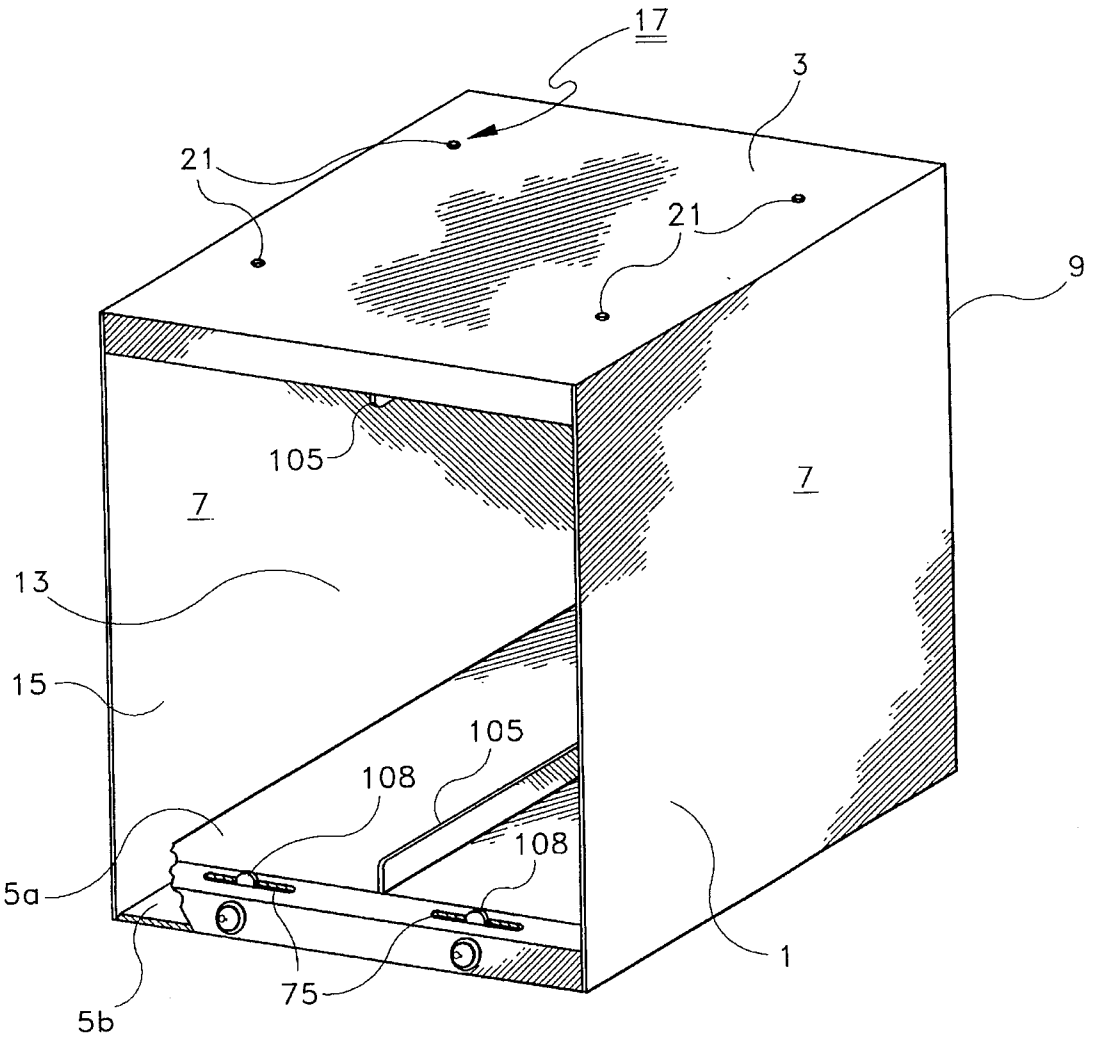
FIG. 5 is another trimetric view of a cash box housing of this invention for holding two cash boxes in side-by-side arrangement.

Turning now to the drawings, where like elements are identified with like numerals throughout the eleven figures, FIGS. 1 and 5 show the preferred embodiment of the invention to comprise a cash box housing 1 having a top plate 3, a pair of closely spaced-apart upper and lower bottom plates 5*a* and 5*b* (covered over by a narrow front wall 6, a pair of wider spaced-apart side plates 7 and a rear plate 9 integrally connected together along their mutual side edges 11 to define a storage cavity 13 accessible through a front opening 15. Said panels are preferably made from cold rolled steel and are connected together through bending from a large plate of steel and welded along their joined sides to form a strong, tamper-resistant housing.

A first means 17 is included in said top plate 3 for attaching said housing to the underside of an overhead support member such as a counter top 19. First means 17 may include a common bracket or, as shown in FIG. 1, merely a plurality of apertures 21 through which screws (not shown) may be inserted and screwed into the underside of counter top 19.

A closed cash box 25 is next provided, defined by a top panel 29, bottom panel 31, a pair of spaced-apart side panels 33, a rear panel 37 and a front panel 39 (see FIG. 2), all integrally connected along their mutually contacting edges, and is of a size and shape to slide into storage cavity 13 through front opening 15 and fit snugly therein with front panel 39 fitting flush against said first opening 15. One or more strips 27 of low friction material, such as polytetrafluoroethylene tape commonly sold under the trademark "Teflon®", may be placed in fore and aft directions along the outside of cash box top panel 29 and bottom panel 31 to aid in sliding cash box 25 into and out of housing 1. Cash box 25 is also preferably made of cold rolled steel bent and/or folded along the respective side edges of said panels and welded or otherwise fastened together.

Figure 2:
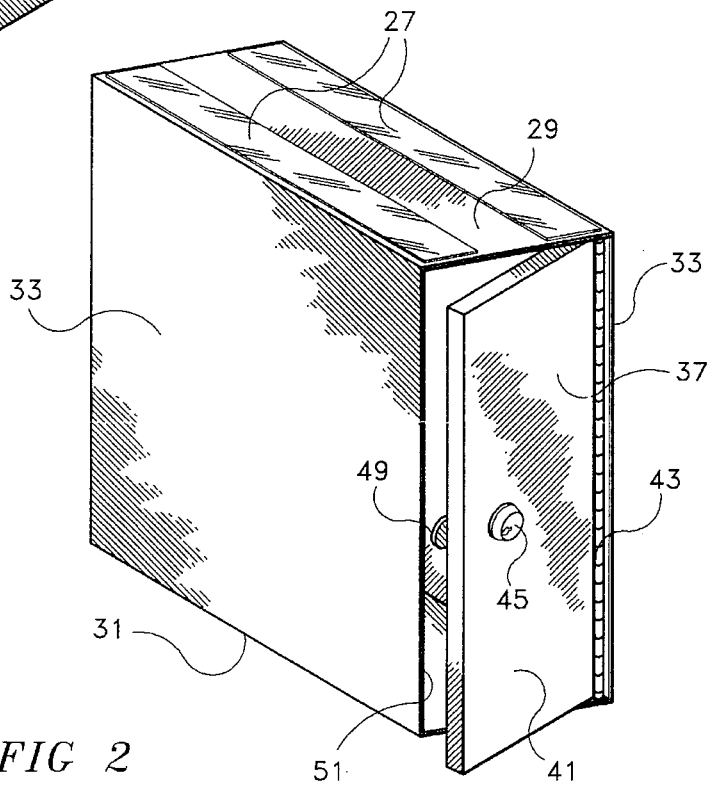
FIG. 2 is a trimetric view of the rear of the preferred embodiment of the cash box showing the access door partially opened for withdrawing the contents of the box.

Rear panel 37 of cash box 25 preferably includes an openable door 41, as shown in FIG. 2, that is pivotally mounted along one side edge with a hinge 43 and lockable with a lock 45 having a hasp 49 that engages an inset edge 51 surrounding the opening at the rear of cash box 25. When cash box 25 is fit into housing 1, door 41 resides at the rear of said box 25 and against housing rear plate 9 so that it is not only out of sight but is armored by both cash box 25 and cash box housing 1.

Said front panel 39 forms a first slot 53 therein, preferably horizontal in arrangement and located near the top of said panel when said box is locked into said housing. Said first slot 53 is for the purpose of passing currency, i.e., bills, coins, tokens, and the like into the interior of said cash box for secure storage therein until said box is removed by authorized personnel.

Figure 3B:
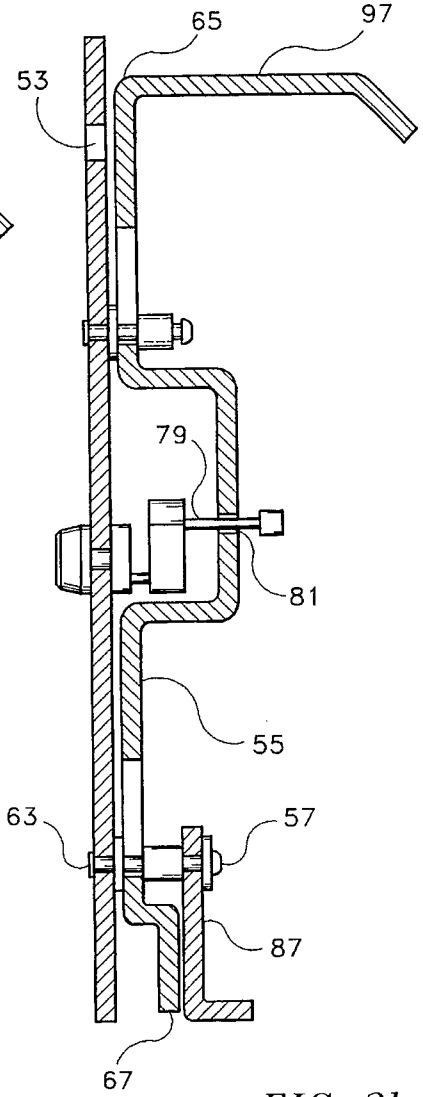
FIG. 3*b* is the same view as in FIG. 3*a* except that the bolt has been raised to lock over the currency intake slot and unlock the cash box from the housing.
Figure 3A:
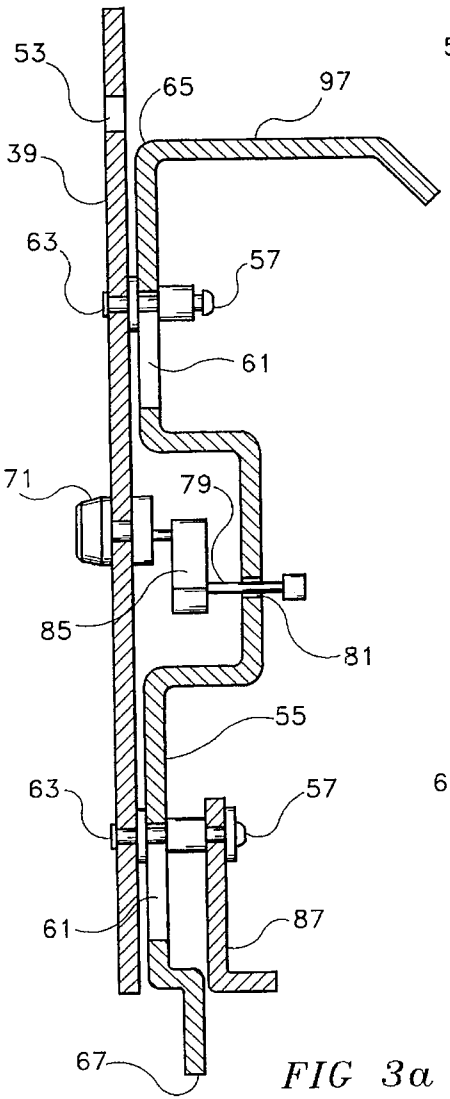
FIG. 3*a* is a partial sectional side view of the bolt of the invention, taken along lines 3—3 in FIG. 1, showing the currency intake slot uncovered and the cash box locked in the housing.

As shown in FIGS. 3*a* and 3*b* , a heavy bolt 55 is positioned inside said cash box front panel 39 and held in sliding relationship thereagainst by a plurality of cover screws 57, passing through a plurality of elongated narrow first notches 61 formed in said bolt, and threaded into studs 63 that are welded or otherwise attached to the inner surface of cash box front panel 39. Bolt 55 is also defined by an upper end 65 and a lower end 67. Bolt 55 is preferably made of hardened steel because it serves a multitude of purposes and requires the strength at both ends to do so.

A unique property of this invention is that bolt 55 performs two important functions simultaneously namely, the covering and uncovering of first slot 53 and the locking of cash box 25 into cavity 13 of cash box housing 1. This is accomplished by forming bolt upper end 65 into a part of a length and width that may be slid upward to cover first slot 53 when cash box 25 is removed from housing 1, and forming bolt lower end 67 into a narrower, flattened bar 69 (see FIG. 4) that is passable or slidable through a second slot 73, formed in cash box bottom panel 31 near the inside of front panel 39 (see FIG. 1) and then into a third slot 75 formed in cash box housing upper bottom plate 5*a* , see FIG. 5. Third slot 75 is formed in upper floor plate 5*a* , located above lower bottom plate 5*b* , interior cavity 13, as shown in FIG. 5.

A turnable lock 77, is mounted on the outside of front panel 39 of cash box 25 and is preferably actionable with an insertable key or other such device (not shown). As shown in FIGS. 3*a* and 3*b* , a leg 79 extends from the rear of lock 77 and engages an elongated narrow second notch 81 formed in an upset 85 located approximately at the middle of bolt 55. The unique aspect of this lock and bolt mechanism is that they perform the functions of unlocking currency intake first slot 53 and simultaneously locking lock box 25 in housing 1 and, alternatively, locking currency intake first slot 53 against entry and simultaneously unlocking cash box 25 for removal from housing 1 in one operation. It takes only one twist of the key in lock 77 to perform these two operations simultaneously. Thus, the operation is speeded up and there is less time available for tampering with cash box 25.

As shown in FIGS. 3*a* and 3*b* , a guide 87 is provided at the base of bolt 55 to maintain said bolt in sliding engagement against front panel 39 so as to maintain, along with studs 63 and cover screws 57, bolt 55 in sliding contact with the inside surface of front panel 39 along its entire length. A handle 89 is conveniently attached by cover plates 91 to the outside of front cash box panel 39 for aid in sliding box 25 into and out of housing 1.

Figure 4:
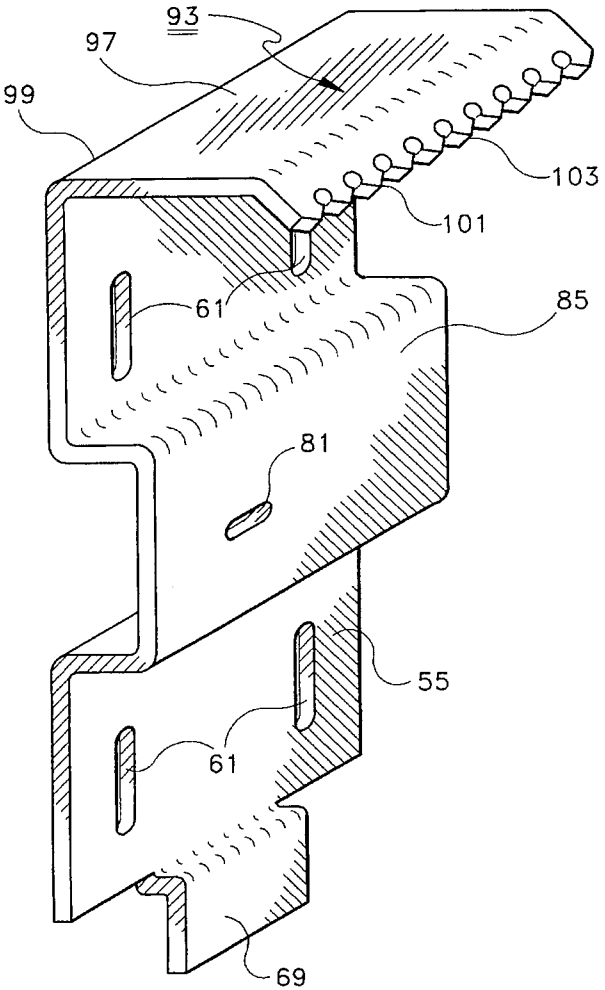
FIG. 4 is a trimetric view of the preferred embodiment of the bolt of this invention.

As shown in FIG. 4, a second means 93 is provided along bolt upper end 65 in the form of an enlarged tab 97 extending inwardly from the fold line 99 where bolt 55 is bent rearward from slot 53. Tab 97 helps prevent one from slipping a wire or string into the interior of cash box 25 through first slot 53 to steal some of the contents in said box. A plurality of teeth 101 are formed along the terminal edge 103 of tab 97 to further prevent theft. Other such means are known in the art and they are fully contemplated in this invention.

Figure 10:
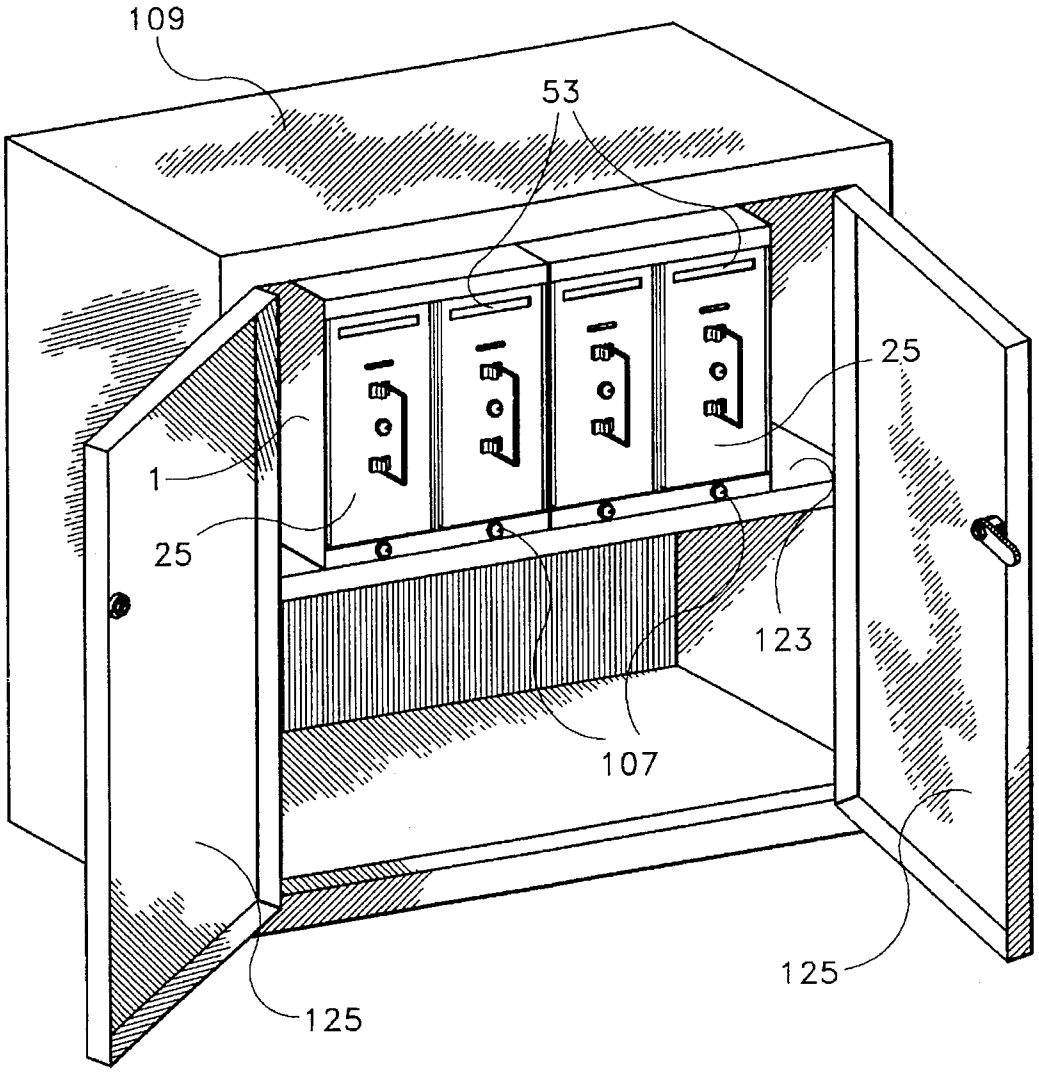

FIG. 5 shows another embodiment of this invention where cash box housing 1 is expanded to hold two (or more) cash boxes 25 in side-by-side arrangement, separated by small wings 105 formed therebetween. FIG. 5 also shows a second pair of turnable locks 107 located at housing front opening 15 on front wall 6 between bottom plates 5*a* and 5*b*. Another unique property of this invention is shown in FIG. 5 in the use of locks 107 to lock cash boxes 25 in side-by-side arrangement in housing 1 that is expanded sideways to hold two of them. Uniquely, either or both cash boxes 25 may be locked in housing 1 for different purposes. For instance, one cash box may be locked in housing 1 using bolt lower end 67 to pass downward through second slot 73 into third slot 75. In this configuration, bolt 55 has uncovered first slot 53 so that currency and the like can be passed into cash box 25. At the same time, the other adjacent cash box 25 may be locked in housing 1 where bolt 55 is in the raised position to cover over slot 53, to prevent insertion of currency into said box, but at the same time be locked in housing 1 using the exact pair of slots 73 and 75. This is accomplished by having a bolt 108 connected to lock 107, interiorly of housing lower front wall 6, that is positioned under third slot 75, to be rotated with said turnable lock 107 through third slot 75 and further through second slot 73. When bolt 55 is raised into its upward position to cover slot 53, it is out of contact with second and third slots 73 and 75 so that by turning lock 107, its bolt 108 is raised through these slots to lock Closed cash box 25 in housing 1. The same front locks 107 can be placed on any housing, such as shown in FIG. 10.

Figure 6:
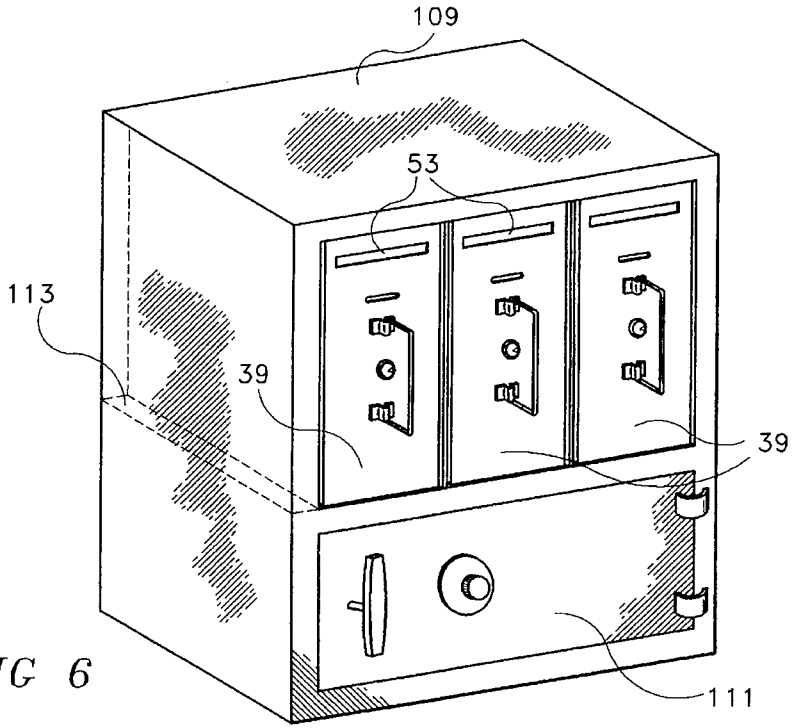
FIG. 6 is an illustrative view of the cash box of this invention shown located in the top of a safe.

FIG. 6 shows a plurality of cash boxes 25 housed in the upper level of a safe 109, where the safe door 111 is located below boxes 25 for access to the interior thereof without having access to the boxes. In this case, housing 1 is formed by the upper side walls, rear wall and top wall of safe 109 and a shelf 113 is used as the bottom plate of housing 1 and also acts to separate housing 1 from the lower interior of safe 109. In this embodiment, third slot 75 will be formed in shelf 113 to accept bolt lower end 67 in locking 28 engagement therewith.

Figure 7:
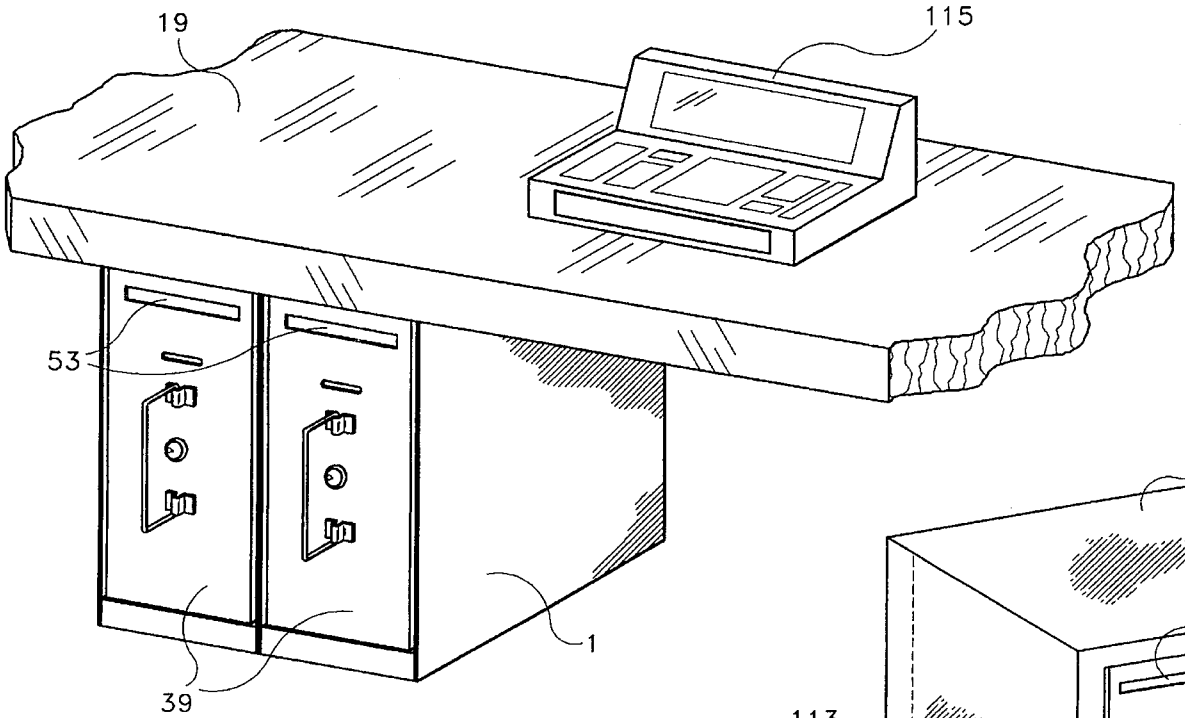
FIG. 7 is an illustrative view of the cash box of this invention shown located under a counter of a fast food restaurant.

FIG. 7 shows the use of a dual cash box housing, of the type shown in FIG. 5, mounted under the counter 19 of a typical fast food restaurant, near a cash register 115, for use in accepting currency and holding it until the manager, or other authorized person, unlocks it and replaces it with an empty cash box.

Figure 8:
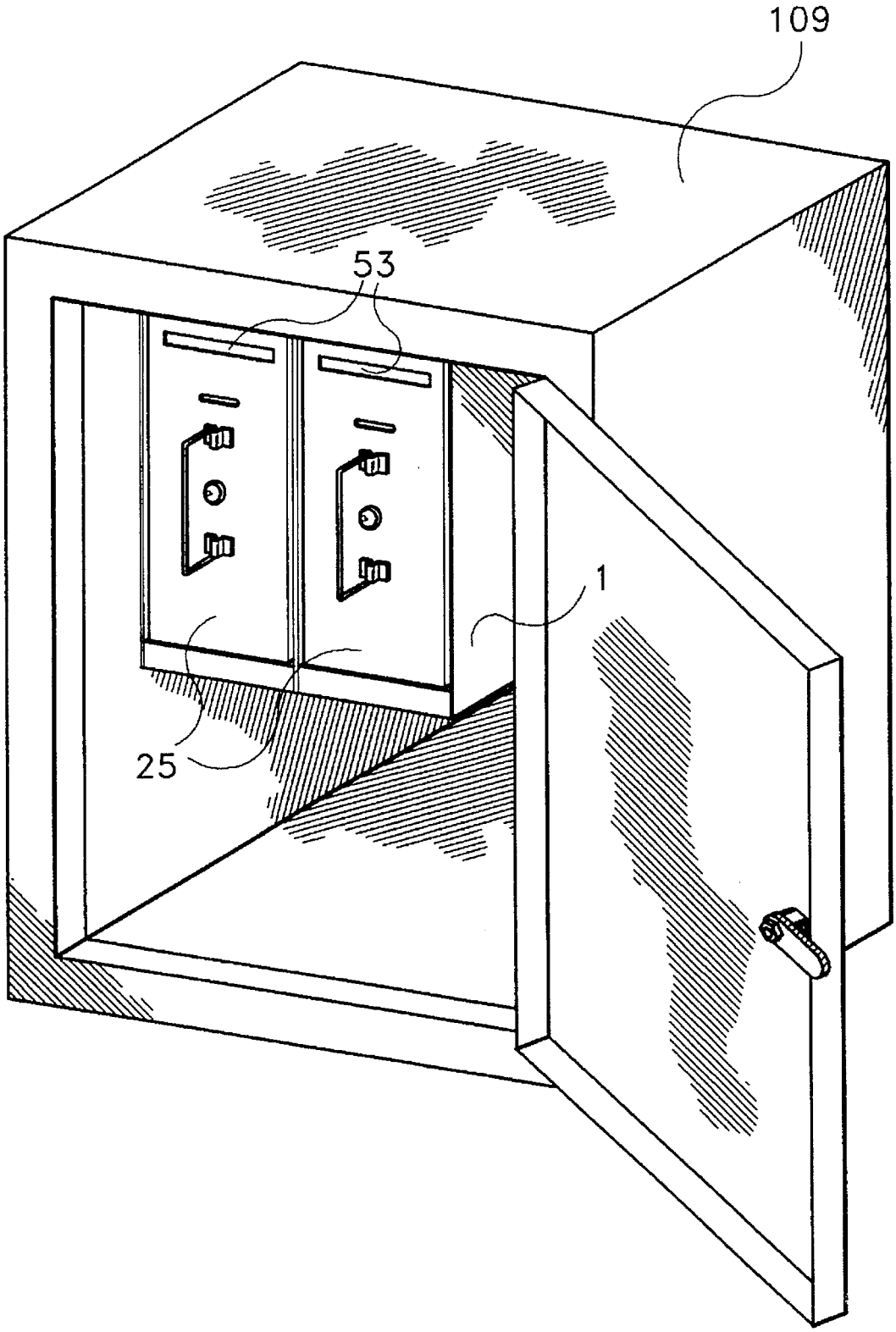
FIG. 8 is an illustrative view of the cash box of this invention shown located inside a safe.

FIG. 8 shows the use of a dual cash box housing, of the type shown in FIG. 5, mounted interior safe 109 and hung from the top plate thereof. In this particular arrangement, cash boxes 25 are locked against entry to any person having access to the interior of safe 109.

Figure 9:
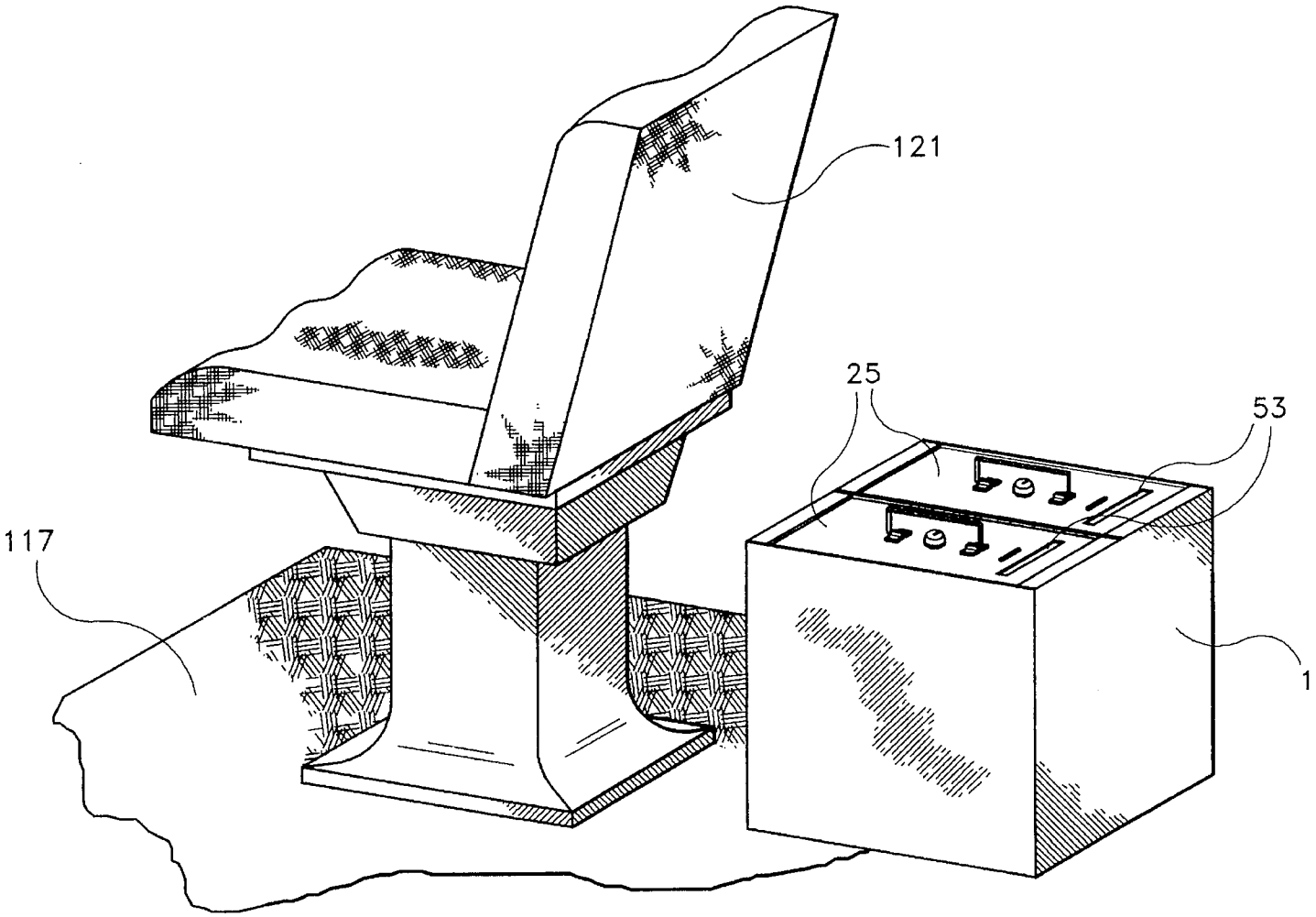
FIG. 9 is an illustrative view of the cash box of this invention shown located behind the driver's seat of a service vehicle such as a Federal Express® vehicle; and, FIG. 10 is an illustrative view of the cash box of this invention shown housed in pairs inside a safe or other storage cabinet.

FIG. 9 shows the use of a pair of cash boxes 25, locked in housing 1, where housing 1 is attached to the floor 117 of a vehicle, behind the driver's seat 121. This not only provides easy access by the driver to the cash boxes, but the boxes are held safe in the housings from theft.

FIG. 10 shows the use of multiple cash boxes 25, held in pairs in housings 1 and mounted on a shelf 123 in a large safe 109 or a storage cabinet. Again, the cash box housings are attached to the top plate, rear plate or side plates of safe 109 through first means 17. The doors 125 of safe 109 merely add further safeguard to cash boxes 25.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same results are within the scope of this invention.

What is claimed is:

1. A tamper-resistant cash box combination comprising:

a) a cash box support structure defining a storage cavity accessible through a front opening;

b) a closed cash box sized to fit snugly into said structure and including:

i) a front panel for fitting flush with said structure front opening;

ii) said front panel forming a first slot therethrough for passing currency and the like into said box;

c) a bolt inside said cash box in slidable engagement with said front panel, said bolt defined by a top end and a bottom end; and, d) a lock on said cash box front panel for moving said bolt upward to cover said first slot and downward through a second slot formed in the bottom of said cash box into a third slot formed in the bottom of said structure to lock said cash box in said structure;

e) where actuation of said lock in one direction locks said cash box in said structure and simultaneously opens said currency-passing first slot for access to the interior of said cash box and actuation of said lock in the other direction unlocks said cash box from said structure for removal therefrom and simultaneously closes said currency-passage first slot to prevent further access to the interior of said cash box.

2. The cash box combination of claim 1 further including an openable door at the rear of said cash box for emptying the contents therethrough, said door remaining hidden from view and inaccessible when said cash box is locked in said structure.

3. The cash box combination of claim 1 further including a handle on the exterior surface of said cash box front panel to aid in manually pushing and pulling said cash box vis-a-vis said housing.

4. The cash box combination of claim 1 further including at least one strip of low friction material attached to an exterior surface of said cash box to aid in smoothly sliding said box into and out of said structure.

5. The cash box combination of claim 1 further including first means for attaching said structure to the underside of an overhanging support member.

6. The cash box combination of claim 5 wherein said first means includes a plurality of apertures formed in said structure through which screws may pass into said overhanging support member.

7. The cash box combination of claim 1 wherein said first slot is located near the top of said cash box front panel.

8. The cash box combination of claim 1 further including second means interior of said first slot for preventing unauthorized removal of the contents of said cash box through said first slot.

9. The cash box combination of claim 8 wherein said second means further includes a tab extending rearward of said bolt into said cash box.

10. The cash box combination of claim 9 wherein said second means further includes a ragged edge formed on said tab interior said cash box.

11. A tamper-resistant cash box combination comprising:

a) an enclosed cash box housing defining a storage cavity accessible through a front opening;

b) a closed cash box sized to fit snugly into said housing and including:

i) a front panel for fitting flush with said housing front opening;

ii) said front panel forming a first slot therethrough for passing currency and the like into said box;

c) a bolt inside said cash box in slidable engagement with said front panel, said bolt defined by a top end and a bottom end; and, d) a lock on said front panel for moving said bolt upward to cover said first slot and downward through a second slot formed in the bottom of said cash box into a third slot formed in the bottom of said housing to lock said cash box in said housing;

e) where actuation of said lock in one direction locks said cash box in said housing and simultaneously opens said currency-passing first slot for access to the interior thereof and actuation of said lock in the other direction unlocks said cash box from said housing for removal therefrom and simultaneously closes said currency-passage first slot to prevent further access to the interior thereof.

12. The cash box combination of claim 11 further including an openable door at the rear of said cash box for emptying the contents thereof, said door remaining hidden from view and inaccessible when said cash box is locked in said housing.

13. The cash box combination of claim 11 further including a handle on the exterior surface of said cash box front panel to aid in manually pushing and pulling said cash box vis-a-vis said housing.

14. The cash box combination of claim 11 further including at least one strip of low friction material attached to an exterior surface of said cash box to aid in smoothly sliding said box into and out of said housing.

15. The cash box combination of claim 11 further including first means for attaching said housing to the underside of an overhanging support member.

16. The cash box combination of claim 15 wherein said first means includes a plurality of apertures formed in said housing through which screws may pass into said overhanging support member.

17. The cash box combination of claim 11 wherein said first slot is located near the top of said cash box front panel.

18. The cash box combination of claim 11 further including second means interior of said first slot for preventing unauthorized removal of the contents of said cash box through said first slot.

19. The cash box combination of claim 18 wherein said second means further includes a tab extending rearward said bolt into said cash box.

20. The cash box combination of claim 18 wherein said second means further includes a ragged edge formed on said tab interior said cash box.

21. A tamper-resistant cash box combination comprising:

a) a cash box housing comprising a top plate, a pair of closely spaced-apart upper and lower bottom plates, a pair of wider spaced-apart side plates and a rear plate, all connected along their mutual side edges to define a storage cavity therein accessible through a front opening, wherein said closely spaced-apart bottom plates are covered over along the front of said housing by a narrow front wall;

b) at least two closed cash boxes, each defined by top, bottom, side and rear panels integrally connected along their mating edges forming a cavity therein, sized to be slid, in side-by-side arrangement, snugly into said housing and each including a front panel adapted to fit flush against said front housing opening;

c) each said cash box front panel forming a first slot into the interior of said cash box for passing currency and the like thereinto;

d) a bolt slidably positioned inside each said cash box and against said cash box front panel defined by an upper end, of a length and width to close over said first slot to completely deny all access to the interior of said cash box, and a lower end of a length and width to pass through a second slot formed in said bottom panel of said cash box and into a third slot formed in said upper bottom plate of said cash box housing to retain said cash box in said housing;

e) a first rotatable lock located in said cash box front panel engaging said bolt and accessible exterior said cash box with an insertable key, so that rotation of said key in one direction causes said bolt to drop through said second slot into said third slot to lock said cash box in said housing and simultaneously open said first slot for access of the interior of said cash box and where rotation of said key in the opposite direction lifts said bolt from said second and third slots to allow said cash box to be withdrawn from said housing and simultaneously lifts said bolt to close said first slot and secure the contents in said cash box; and, f) a second rotatable lock located in said narrow front wall, between said upper and said lower bottom plates, and having a bolt, turnable with said lock for passing through said third slot and into said second slot, when said bolt is raised to cover said first slot, to lock said cash box in said housing when said cash box is closed against insertion of currency or the like thereinto.

22. The cash box combination of claim 21 further including a second rotatable lock located in said narrow front wall for each cash box.

23. The cash box combination of claim 21 further including an openable door at the rear of each said cash box for emptying the contents thereof that remains hidden from view and inaccessible when said cash box is locked in said housing.

24. The cash box combination of claim 21 further including a handle on the exterior surface of each said cash box front panel to aid in manually pushing and pulling said cash box vis-a-vis said housing.

25. The cash box combination of claim 21 further including a strip of low friction material attached to the exterior surfaces of each said cash box to aid in smoothly sliding said boxes into and out of said housing.

26. The cash box combination of claim 21 further including first means for attaching said housing to the underside of an overhanging support member.

27. The cash box combination of claim 21 wherein said first slot is located near the top of said cash boxes front panels.

28. The cash box combination of claim 21 further including second means interior of each said first slot for preventing unauthorized removal of the contents of said cash box out through said first slot.

29. The cash box combination of claim 28 wherein said second means further includes a tab extending rearward of each said bolt into each said cash box.

30. The cash box combination of claim 28 wherein said second means further includes a ragged edge formed on said tab interior said cash box.

* * * * *